US005263650A

United States Patent [19]

Yasui et al.

[11] Patent Number: 5,263,650

[45] Date of Patent: Nov. 23, 1993

[54] PROCESS FOR PRODUCING HIGH BULK DENSITY GRANULAR DETERGENT

[75] Inventors: Hisato Yasui; Hiroshi Noro; Hideyoshi Tanaka, all of Wakayama, Japan

[73] Assignee: Kao Corporation, Tokyo, Japan

[21] Appl. No.: 876,420

[22] Filed: Apr. 30, 1992

[30] Foreign Application Priority Data

May 9, 1991 [JP] Japan ..... 3-104235

[51] Int. Cl.[5] ..... B02C 23/20

[52] U.S. Cl. ..... 241/22; 241/24; 241/25; 264/117

[58] Field of Search ..... 241/22, 24, 25; 264/115, 117

[56] References Cited

U.S. PATENT DOCUMENTS 3,601,321 8/1971 Barth et al. ..... 241/24 X
5,018,671 5/1991 Tanimoto et al. ..... 241/16

FOREIGN PATENT DOCUMENTS 0388705 9/1990 European Pat. Off. .
63-150398 6/1988 Japan .
0643528 1/1979 U.S.S.R. ..... 241/24
1013512 12/1965 United Kingdom .

OTHER PUBLICATIONS

Chemical Abstracts, vol. 109, No. 20, Nov., 1988, Columbus, Ohio, US; abstract No. 172602.

*Primary Examiner*—Eugenia Jones
*Assistant Examiner*—Raymond D. Woods
*Attorney, Agent, or Firm*—Sughrue, Mion, Zinn, Macpeak & Seas

[57] ABSTRACT

A process for producing a high bulk density granular detergent involving the steps of:

(1) milling a solidified detergent material;
(2) classifying the milled detergent material obtained in step (1) into fine powders and coarse powders;
(3) granulating the fine powders classified in step (2);
(4) mixing the granulation product of fine powders obtained in step (3) with the course powders classified in step (2); and
(5) surface modifying the mixture obtained in the step (4).

4 Claims, 2 Drawing Sheets

PROCESS FOR PRODUCING HIGH BULK DENSITY GRANULAR DETERGENT

FIELD OF THE INVENTION

This invention relates to an improved process for producing a high bulk density granular detergent in which a detergent material is milled and granulated.

BACKGROUND OF THE INVENTION

Powder detergents, which have been commonly used for domestic purposes, are advantageous in high fluidity, high caking resistance, little dusting, good handling characteristics and high solubility. Most of these powdery detergents are produced by spray drying.

In recent years, the demand for high bulk density granular detergents, which are reasonable from the viewpoint of conservation of resources and convenient for consumers from the viewpoint of easiness in carrying, has been increasing.

However spray-dried detergent particles generally have a bulk density of 0.4 g/cm$^3$ or below and an average particle size of from 20 to 1,000 μm. Therefore it is difficult to obtain a high bulk density granular detergent directly by conventional spray drying methods.

Known methods for producing high bulk density granular detergents include a method comprising granulating spray-dried detergent particles as disclosed, for example, in JP-A-61-69897 (the term "JP-A" as used herein means an "unexamined published Japanese patent application"); a method comprising compressing spray-dried detergent particles and then milling and granulating as disclosed, for example, in JP-A-61-69899; a method comprising mixing, solidifying and breaking-up a detergent material as disclosed, for example, in JP-A-61-76597; a method comprising mixing detergent powders followed by solidifying and multi-step milling as disclosed, for example, in JP-A-63-150398; and a method comprising continuously granulating detergent particles as disclosed, for example, in JP-A-2-232299 (corresponding to U.S. Pat. No. 5,018,671).

However, these known methods suffer from various disadvantages as follows. In the method disclosed in JP-A-61-69897 which comprises mixing, agitating and granulating a spray-dried product, it is very difficult to control the particle size and bulk density of the resulting granular product. In addition, the achievement of a high bulk density is accompanied by a poor yield and, furthermore, the use of the spray-dried product of a low density makes it necessary to use a large-scaled equipment.

In the method disclosed in JP-A-61-69899 which comprises compressing a spray-dried product followed by milling and granulating, a large amount of fine powders are formed during the milling step, which causes problems in qualities and productivity and, further, a uniform particle size can hardly be obtained by this method.

In the method disclosed in JP-A-61-76597 which comprises breaking and granulating a solid detergent material, both of the moisture content of the starting material and the breaking time are restricted. Thus this method is not commonly applicable from the viewpoints of operation characteristics and the composition.

In the method disclosed in JP-A-63-150398 which comprises multi-step milling step where the formation of fine powders is prevented, a solid detergent material is fed into a cutter type mill of a large screen pore size to other ones of smaller screen pore sizes successively when the solid detergent material is milled and granulated. However, the method requires a large equipment to perform the multi-step treatment on an industrial scale.

In the method disclosed in JP-A-2-232299 (corresponding to U.S. Pat. No. 5,018,671) which comprises continuously granulating detergent particles, a distribution in the residence time during the continuous operation makes it difficult to achieve a uniform grain size distribution. Further, this method suffers from some problems in the suppression of the formation of fine powders and in the control of bulk density.

SUMMARY OF THE INVENTION

In order to solve these problems observed in the conventional methods, the present inventors have conducted extensive studies and, as a result, they have successfully developed a process for producing a high bulk density granular detergent, wherein a detergent material is milled and classified into fine powders and coarse powders, followed by performing granulation and surface modifying to thereby make it possible to give a granular detergent of a uniform particle size, to control the bulk density of the product on an industrial scale and to reduce the scale of the production equipment, thus completing the present invention.

Accordingly, the present invention provides a process for producing a high bulk density granular detergent which comprises the steps of:

(1) milling a solidified detergent material;

(2) classifying the milled detergent material obtained in the step (1) into fine powders and coarse powders;

(3) granulating the fine powders classified in the step (2);

(4) mixing the granulation product of the fine powders obtained in the step (3) with the course powders classified in the step (2); and (5) surface modifying the mixture obtained in the step (4).

In these figures, 1 represents a milled detergent material; 2 represents classified fine powders; 3 represents classified coarse powders; 4 represents a granulation product obtained by granulating the entire milled detergent material; 5 represents a granulation product of fine powders obtained in the granulation step (3); and 6 represents a granular detergent obtained in the surface modifying step (5).

DETAILED DESCRIPTION OF THE INVENTION

The present invention provides a process for producing a high bulk density granular detergent which has been developed by paying attention to the grain size distribution of a milled detergent material and that of a high bulk density granular detergent. Now the difference between the process of the present invention and conventional processes will be illustrated by reference to FIG. 1.

Figure 1A:
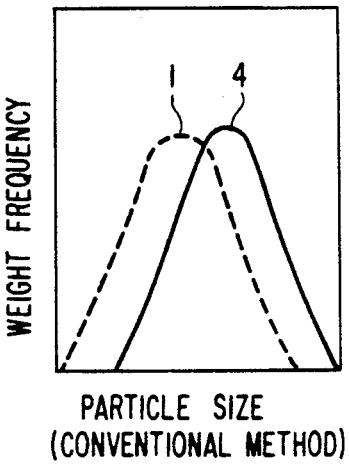
FIGS. 1 (*a*), (*b*) and (*c*) are graphs each showing the particle size distribution for producing a high bulk density granular detergent.
Figure 1B:
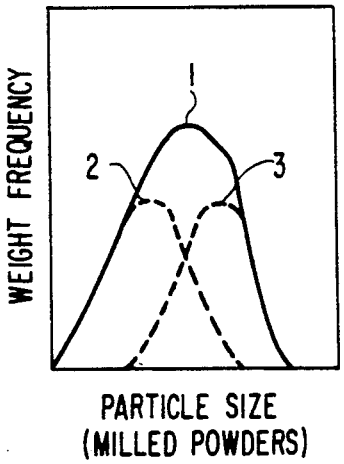
Figure 1C:
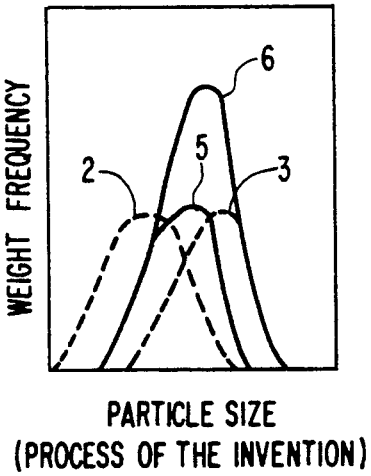

According to a conventional granulation method, only a granular detergent of a large particle size as the whole can be obtained from a milled detergent material 1. Namely, the particle size of the milled detergent material 1 merely shifts to the particle size of the granulation product 4, as shown by FIG. 1 (*a*). Thus, uniform particles can hardly be obtained in the conventional method. In addition, a prolonged granulation time is required in order to reduce the amount of the fine powder, thereby granules of too large particle size are formed and reduction in the yield is caused. In the process of the present invention, on the other hand, attention is paid to the grain size distribution of the milled detergent material 1. That is to say, the milled detergent material is classified into fine powders 2 and coarse powders 3, as shown by FIG. 1 (*b*). Next, the fine powders 2 alone are subjected to granulation to thereby give a granulation product of the fine powders 5, as shown by FIG. 1 (*c*). Then the coarse powders 3 are mixed with the granulation product of the fine powders 5 and subjected to surface modifying. Thus, a granular detergent 6 is obtained. The resulting granular detergent contains detergent particles of uniform grain size and has an excellent dispersibility and a high solubility in water.

By adjusting the amount of the fine powders to be subjected to granulation, it is also possible to change the void volume of the granulation products to thereby control the bulk density of the resulting granular detergent.

According to the process of the present invention, furthermore, since the coarse powders 3 have a relatively large particle size, they are not particularly required to be granulated during the surface modifying step, so that the coarse powders are simply subjected to surface modification with a surface modifier during the surface modifying step. Thereby, the period required for granulation can be shortened in the process of the present invention. Thus granulation can be effectively completed within a short period of time with a high yield. As a result, the device and equipment to be employed in the production of granular detergent can be down-sized.

The present invention will be described below in greater detail.

The detergent material to be used in the present invention may be solidified by dense-kneading a detergent material with a kneader or drying a detergent materials for a detergent paste and pelleting the dried detergent material using, for example, an extruding machine.

The detergent material to be used in the process of the present invention comprises a surfactant and a builder. Further, a surface modifier may be added at the surface modifying step (5). If necessary, a milling aid may be added in the milling step (1), and a builder may be added in the granulation step (2).

The surfactant and the builder to be used as the detergent components and the surface modifier to be mixed during the step of surface modifying are not particularly restricted. For example, those described in JP-B-4-5080 (the term "JP-B" as used herein means an "examined Japanese Patent Publication") may be used therefor. Further, silicate compounds having an ion-exchanging ability of 100 to 500 ($CaCO_3$ mg/g) such as sodium silica-based and potassium silica-based silicate compounds are also suitably used as the builder. In addition to these surfactants, surface modifiers or builders, there may be further added detergent components commonly used in the production of high bulk density granular detergents as described in the above-mentioned JP-A-61-69897, for example, capturing agents, staining inhibitors and bleaching agents.

The content of the surfactant in the detergent material may range from 10 to 70 parts by weight, preferably from 25 to 50 parts by weight. The content of the builder in the detergent material may range from 90 to 30 parts by weight, preferably from 75 to 50 parts by weight.

Figure 2:
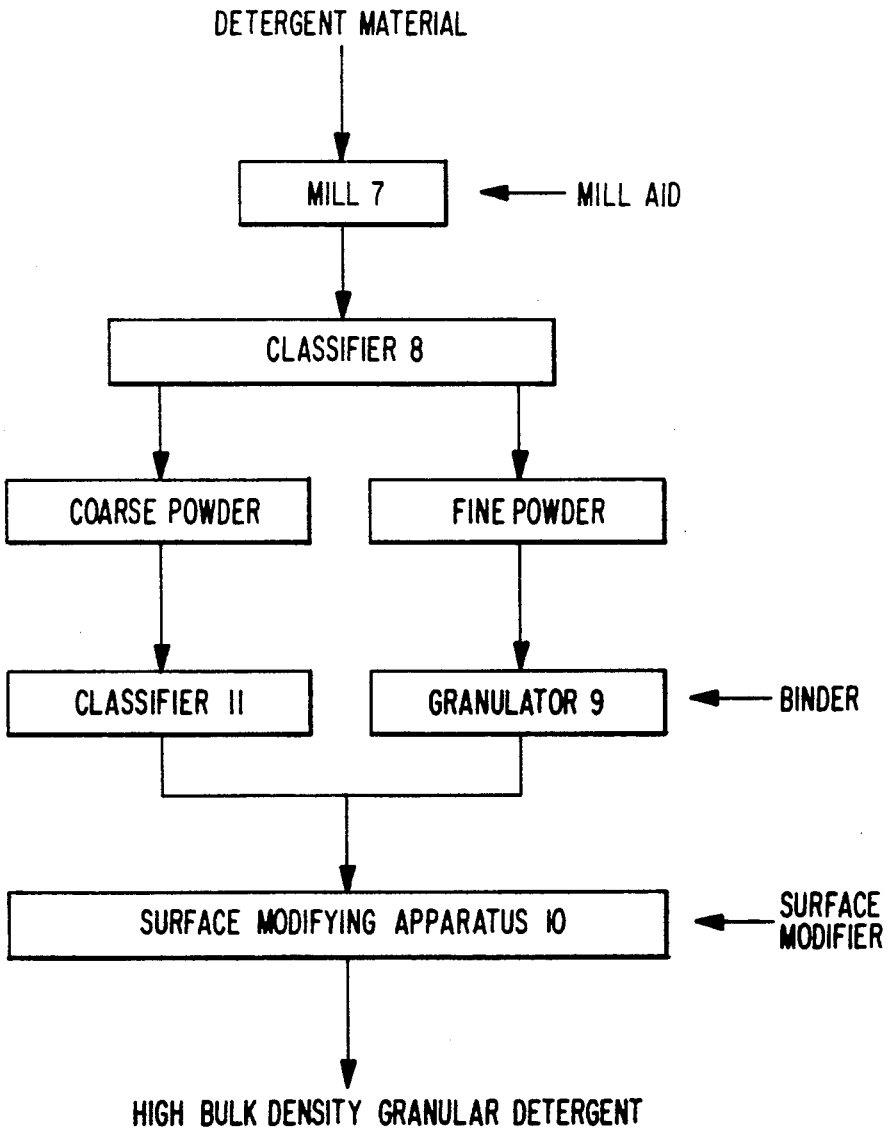
FIG. 2 is a flow sheet summarizing an embodiment of the process of the present invention for producing a high bulk density granular detergent.

Now, a preferred embodiment of the present invention will be described with reference to FIG. 2.

The solidified detergent material obtained as mentioned above is finely milled in a cutter type or impact type mill 7 and then fed into a classifier 8.

Examples of the mill to be used in the present process include Fizz-Mill (tradename, a product of Hosokawa Micron K.K.), Turbo-Mill (tradename, a product of Turbo Kogyo K.K.), Impeller Mill (tradename, a product of Seishin Enterprize K.K.), Contraplex (tradename, a product of POWREX) and Victory Mill (tradename, a product of Hosokawa Micron K.K.). These mills may be used either in one-step manner or in multi-step manner, depending on the aimed particle size of the powder.

The average particle size of the final milled product may range from 200 to 1,500 μm, preferably from 300 to 700 μm.

The milled detergent material thus obtained is then classified into fine powders and coarse powders with a classifier 8 of a screen type, a wind power type or the like type. Then the fine powders are fed into a granulator 9 while the coarse powders are fed into a surface modifying apparatus 10.

As the classifiers, Micron Separator (tradename, a product of Hosokawa Micron K.K.) or Gyro Shifter (tradename, a product of Tokuju Kosakusho K.K.) may be used.

Since fine powder particles of the detergent material are highly sticky and thus frequently cause jamming of screens, a wind power type or inertial type classifier is preferred therefor as compared to a screen type one. In this classification step, the fine powders and the coarse powders are classified from each other at a parting particle size ranging from 50 to 1,000 μm, preferably from 200 to 600 μm.

The fine powders of the detergent composition thus classified are then fed into the granulator 9, and they are agitated and granulated therein.

The classification is conducted so as to classify the fine powders in an amount of from 15 to 85 parts by weight, preferably from 30 to 70 parts by weight, based on the total weight of the milled detergent material. When the milled detergent material are classified so as to give an amount of the fine powder of less than 15 parts by weight, an amount of the powders of somewhat larger particle sizes which serve as granulation nuclei in granulation may be insufficient and, as a result, the granulation efficiency at granulation is lowered. In this case, furthermore, a large amount of fine powders attaches to the coarse powder and it comes over during the surface modifying step accompanying to the coarse powders, which makes it difficult to reduce the amount of the fine powders in the final product. Furthermore, when classification is conducted so as to give the amount of the fine powders of less than 15 parts by weight, control of the bulk density, which is an object of the present invention, becomes substantially difficult.

When the amount of the fine powders exceeds 85 parts by weight, on the other hand, the effect of controlling the bulk density does not occur. Further, an amount of the coarse powders, granulation of which is not particularly required, in the fine powders is increased and they undergo unnecessary granulation, thereby the granulation efficiency is lowered.

On the other hand, the amount of the coarse powders classified in the classification step may range from 85 to 15 parts by weight, preferably from 70 to 30 parts by weight. When the amount of the coarse powders exceeds 85 parts by weight or is less than 15 parts by weight, undesirable results similar to those described above are observed.

In order to efficiently granulate the fine powders of the classified detergent material, it is preferable that the fine powders contain powders of somewhat larger particles, which are capable of serving as nuclei of granules. In order to adjust the void volume of the granulated product to control its bulk density, a classification efficiency is an important factor. Namely, it is preferable to conduct the classification so as to achieve a Newton classification efficiency of from 30 to 90%. The "Newton classification efficiency" is defined, for example, in Rietema, K., Chem. Eng. Sci., 7, 89 (1957).

It is preferable to control the temperature of the fine powders during the granulation step to from 20° to 60° C., preferably from 20° to 40° C. When the temperature is lower than 20° C, it is required to add a binder to efficiently achieve granulation. When it exceeds 60° C., the fine powders of the detergent material tends to stick to the bottom and the side wall of the granulator 9 and thus large particles may be formed, which causes a decrease in the production yield. In this case, furthermore, the increase in the mechanical and electrical power due to the sticking of the detergent material makes the operation of the machine unstable. The fine powders thus granulated with the granulator 9 are then fed into the surface modifying apparatus 10 having a similar structure with the granulator 9, and mixed with the coarse powder classified with the classifier 8. Then the mixture is agitated and mixed to thereby give a high bulk density granular detergent.

The coarse powders to be fed into the surface modifying apparatus 10 may be previously cut with a preliminarily classifier 11 to thereby further improve the uniformity of the detergent particle size.

It is preferable to add a milling aid in the milling step (1) so as to reduce the mechanical and electrical power and to improve the milled grain size. In the surface modifying step, a surface modifier may be added so as to coat the surface of the high bulk density granular detergent particles with fine particulate of the surface modifier. Thus, the fluidity of the high bulk density granular detergent is improved and the caking of the product can be prevented.

In the granulation step, a binder may be added so as to control the granulation properties. As a result, the granulation product of the fine powders can be efficiently produced within a shortened treatment period and at an elevated yield. Examples of the apparatus to be used in granulation and in surface modifying are rolling-mixers including High-Speed Mixer (tradename, a product of Fukae Powtec Corp.), Henschel Mixer (tradename, a product of Mitsui Miike Machinery Co., Ltd.), Lödige Mixer (tradename, a product of Matsuzaka Boeki K.K.) and Marumelizer (tradename, a product of POWREX).

The above-mentioned granulation and surface modifying may be performed by using either batch-type or continuous-type rolling-mixers. Furthermore, the high bulk density granular detergent can be obtained by performing both of granulation and surface modifying in a single apparatus.

The average particle size of the granulation product obtained in the granulation step (3) is preferably from 200 to 1,000 μm, more preferably from 200 to 600 μm. The average particle size of the high bulk density granular detergent produced in the process of the present invention is preferably from 300 to 1,000 μm, more preferably from 300 to 700 μm. Further, the bulk density of the high bulk density granular detergent preferably ranges from 0.6 to 0.9 g/cm$^3$.

As the milling aid and the surface modifier, crystalline or amorphous aluminosilicates are preferred since they would capture calcium ions during washing. It is particularly preferable to use crystalline or amorphous aluminosilicates of an average primary particle size of from 0.01 to 10 μm. Further, silicate compounds having an ion-exchanging ability of 100 to 500 ($CaCO_3$ mg/g) (e.g., sodium silica-based and potassium silica-based silicate compounds) and having an average primary particle size of 0.01 to 10 μm may preferably be used. Alternately, inorganic fine powders (for example, silicon dioxide, bentonite, talc, clay, titanium dioxide, stearates) of an average primary particle size of from 0.01 to 10 μm may be used therefor.

When the aforesaid milling aid and surface modifier are employed, they may respectively be added at a ratio of from 1 to 20 parts by weight, per 100 parts by weight of the detergent composition, so as to achieve the aimed product. When the amount of the milling aid is less than 1 part by weight, only a poor milling efficiency is achieved and, therefore, the milled product can hardly be formulated into a fine powders. In this case, furthermore, the milled product tends to frequently stick to the inner wall of the mill and the rotating impact blades, which makes stable operation for a prolonged time impossible. When the amount of the surface modifier is less than 1 part by weight, any high bulk density granular detergent having a good fluidity and a high caking resistance can be hardly obtained. When the amount of the milling aid or the surface modifier exceeds 20 parts by weight, on the other hand, then granulation properties of the milled detergent composition are deteriorated and the treatment capacity is reduced. In this case, furthermore, there is a risk that undesirable dusting occurs at the use. It is preferable that the surface modifier to be used in the present invention has an average primary particle size of from 0.01 to 10 μm.

The above-mentioned binder would impart an appropriate stickiness to the milled detergent material so as to retain the shape of the granular detergent. Examples thereof include water, polyhydric alcohols and aqueous solutions of polymers such as carboxycellulose. Water may be preferably used therefor in particular.

The above-mentioned binder, if used, may be added at a ratio of from 0.1 to 5 parts by weight per 100 parts by weight of the detergent material so as to achieve the aimed product. When the amount of the binder is less than 0.1 part by weight, the stickiness of the milled detergent material is not very improved appropriately in the granulation step. When the amount thereof exceeds 5 parts by weight, on the other hand, the milled detergent material tends to stick to the inner wall of the rolling/milling granulator, which makes stable operation for a prolonged period impossible. In this case, furthermore, a rapid change in the granulation properties makes it difficult to control the granulation properties. As a result, there is a risk that the formation of large particles lowers the productivity.

According to the process of the present invention for producing a high bulk density granular detergent, the grain size distribution of a milled detergent material is controlled by classification and thus a high bulk density granular detergent of a uniform particle size and appropriately controlled bulk density can be obtained via granulation and surface modifying. As a result, the scale of the production equipment can be successfully reduced.

To further illustrate the present invention in greater detail, and not by way of limitation, the following Examples will be given.

EXAMPLE 1 AND COMPARATIVE EXAMPLE 1

(1) Production of milled detergent material

A detergent material of a moisture content of 30% was kneaded in a kneader (1600-65CVJA-3,7 type, a product of Satake Kikai Kogyo K.K.) and then dried with a film dryer (Vertical Contro 0.3 $m^2$, a product of Hitachi, Co.). Then it was pelleted with an extruder (125 W One-step Vacuum Extruder, a product of Sato Tekkosho K.K.) and milled with a Turbo Mill (T-400 type, a product of Turbo Kogyo K.K.). Thus a milled detergent composition of the following composition was obtained.

| Component | Amount (parts by weight) |
|---|---|
| Straight-chain sodium alkylbenzenesulfonate ($C_{10}$–$C_{13}$) | 25 |
| Sodium alkylsulfate ($C_{12}$–$C_{18}$) | 10 |
| Nonionic surfactant (polyoxyethylene alkyl ether ($C_8$–$C_{14}$; average added mol number of ethylene oxide: 10 mol) | 3 |
| Soap (sodium salt of fatty acids having 14 to 18 carbon atoms) | 3 |
| Zeolite (4A type) | 25 |
| Sodium carbonate | 10 |
| Sodium silicate No. 2 ($Na_2.2.5SiO_2$) | 15 |
| Sodium sulfate | 1 |
| Polyethylene glycol 6000 | 2 |
| Water | 6 |

(2) Granulation of milled detergent material 3,500 g of the milled detergent material obtained in the above procedure (1) was classified into fine powders (57 parts by weight) and coarse powders (43 parts by weight) with the use of a 32-mesh screen (Gyro Shifter CS-BS-AM type, a product of Tokuju Kosakusho K.K.). The fine powders thus classified were then fed into a rolling/mixing granulator (High-Speed Mixer FM20J type, Fukae Powtec Corp.) and subjected to granulation therein. Next, the granulated fine powders thus obtained were collected from the granulator and 1,995 g of them were fed into the same rolling/milling granulator together with 1505 g of the coarse powders classified above, followed by subjecting the mixture to surface modifying.

In Comparative Example 1, the total amount (3,500 g) of the detergent material obtained in the above procedure (1) was fed into the rolling/mixing granulator, without subjecting classification, and conducted granulation therein.

Table 1 summarizes the results.

In Example 1 and Comparative Example 1, the average particle size and the bulk density were determined in accordance with the methods specified in JIS K 3362.

The uniformity of the granules was evaluated in the following manner. The particle sizes corresponding to the partial weight ratios of 10% and 60%, determined by the method for measuring grain size distribution as specified in JIS K 3362, were referred to as $D_{10}$ and $D_{60}$ respectively. Then the value of the particle size ratio ($D_{60}/D_{10}$) was employed as an indication of the uniformity of the granules. That is to say, granules having a particle size ratio close to 1 is evaluated as highly uniform and highly fluidable.

TABLE 1

| | Example 1 | Comparative Example 1 |
|---|---|---|
| Granulation method | Granulation and Surface Modifying | Granulation of Total Milled Detergent Material |
| Milled detergent material: | | |
| Average particle size (μm) | 388 | 388 |
| Fine powder of the particle size of less than 125 μm (%) | 13.5 | 13.5 |
| Granulation conditions: | | |
| Rotation rate of the agitation impeller (m/sec.) | 6.0 | 6.0 |
| Granulation period (min.) | 3.2 | 3.0 |
| Granulated product temp. (°C.) | 33.6 | 34.2 |
| Surface modifying conditions: | | |
| Amount of granulation product of fine powder (g) | 1995 | 0 |
| Amount of classified coarse powder (g) | 1505 | 0 |
| Amount of milled detergent material (without classification) (g) | 0 | 3500 |
| Rotation rate of the agitation impeller (m/sec.) | 5.0 | 5.0 |
| Surface modifying period (min.) | 1.0 | 1.0 |
| Properties of granular detergent: | | |
| Average particle size (μm) | 456 | 467 |
| Ratio of fine powder of the particle size of less than 125 μm (%) | 2.6 | 1.7 |
| Bulk density (g/$cm^3$) | 0.67 | 0.70 |
| Uniformity [-] | 2.33 | 2.80 |

EXAMPLES 2 TO 4

(1) Production of milled detergent composition

The procedure of Example 1 was repeated.

(2) Granulation of milled detergent composition

The milled detergent material obtained in the above procedure (1) was classified into fine powders and coarse powders with a wind power classifier (Micron Separator MS1 type, a product of Hosokawa Micron K.K.). 3,500 g of the fine powder was then fed into a rolling/mixing granulator (High-Speed Mixer FM20J type, a product of Fukae Powtec Corp.) and subjected to granulation therein. Next, the fine powders thus granulated and then coarse powders classified above were mixed with each other so as to give the total amount of the fine powders and the coarse powders of 3,500 g and each ratio as specified in Table 2. The resulting mixture was fed into the rolling/mixing granulator and subjected to surface modifying therein.

Table 2 summarizes the results.

In the surface modifying step, 4 parts by weight, based on 100 parts by weight of the detergent material, of a powdery zeolite (4A type, average particle size: 4.2 μm) was added as a surface modifier. In Example 5, 18 g of water was further added as a binder in the granulation step.

TABLE 2

| | Example | | | |
|---|---|---|---|---|
| | 2 | 3 | 4 | 5 |
| Detergent composition: | | | | |
| Average particle size (μm) | 415 | 415 | 415 | 415 |
| Fine powders of the particle size of less than 125 μm (%) | 8.9 | 8.9 | 8.9 | 8.9 |
| Classification conditions: | | | | |
| Feeding amount (kg/hr.) | 1092 | 1028 | 633 | 284 |
| Rotation rate of the classification rotor (rpm) | 230 | 151 | 0 | 0 |
| Amount of fine powders (part by weight) | 56 | 63 | 78 | 84 |
| Amount of coarse powder (part by weight) | 44 | 37 | 22 | 16 |
| Ratio of detergent material to air (kg detergent material/kg air) | 0.9 | 0.8 | 0.5 | 0.23 |
| Granulation conditions: | | | | |
| Rotation rate of the agitation impeller (m/sec.) | 6.0 | 6.0 | 6.0 | 6.0 |
| Amount of water added (g) | 0 | 0 | 0 | 18 |
| Granulation period (min.) | 1.8 | 1.8 | 2.0 | 1.8 |
| Granulated product temp. (°C.) | 34.9 | 34.7 | 34.9 | 34.2 |
| Surface modifying conditions: | | | | |
| Amount of granulation product of the fine powders (g) | 1960 | 2205 | 2730 | 2940 |
| Amount of the classified coarse powders (g) | 1540 | 1295 | 770 | 560 |
| Amount of surface modifier (g) | 140 | 140 | 140 | 140 |
| Rotation rate of the agitation impeller (m/sec.) | 5.0 | 5.0 | 5.0 | 5.0 |
| Surface modifying period (min.) | 1 | 1 | 1 | 1 |
| Product temp. (°C.) | 34.1 | 34.3 | 34.7 | 34.2 |
| Properties of granular detergent: | | | | |
| Average particle size (μm) | 425 | 432 | 433 | 525 |
| Ratio of fine powder of the particle size of less than 125 μm (%) | 4.0 | 4.3 | 2.9 | 1.4 |

TABLE 2-continued

| | Example | | | |
|---|---|---|---|---|
| | 2 | 3 | 4 | 5 |
| Bulk density (g/cm$^3$) | 0.66 | 0.69 | 0.71 | 0.72 |

According to the process for producing a high bulk density granular detergent of the present invention wherein a milled detergent material is classified into fine powders and coarse powders, followed by performing a granulation and surface modifying, it becomes possible to give a granular detergent of a uniform particle size, to control the bulk density of a granular detergent, and to reduce the scale of the production equipment.

While the invention has been described in detail and with reference to specific embodiments thereof, it will be apparent to one of ordinary skilled in the art that various changes and modifications can be made therein without departing from the spirit and scope thereof.

What is claimed is:

1. A process for producing a high bulk density granular detergent which comprises the steps of:

(1) milling a solidified detergent material;

(2) classifying the milled detergent material obtained in said step (1) into fine powders and coarse powders;

(3) granulating the fine powders classified in said step (2);

(4) mixing the granulation product of fine powders obtained in said step (3) with the coarse powders classified in said step (2); and (5) surface modifying the mixture obtained in the step (4), wherein an amount of said fine powders obtained in said step (2) ranges from 15 to 85 parts by weight and an amount of said coarse powders obtained in said step (2) ranges from 85 to 15 parts by weight.

2. A process of claim 1, wherein a surface modifier is mixed with the granulation product of the fine powders and the coarse powders in said step (5).

3. A process of claim 1, wherein a binder is added to the fine powders in said step (3).

4. A process of claim 1, wherein a milling aid is added to the solidified detergent material in said step (1).

* * * * *